US005225308A

United States Patent [19]

Sasaki et al.

[11] Patent Number: 5,225,308

[45] Date of Patent: Jul. 6, 1993

[54] ENCAPSULATED TONER FOR HEAT-AND-PRESSURE FIXING

[75] Inventors: Mitsuhiro Sasaki; Kuniyasu Kawabe, both of Wakayama, Japan

[73] Assignee: Kao Corporation, Tokyo, Japan

[21] Appl. No.: 680,538

[22] Filed: Apr. 4, 1991

[30] Foreign Application Priority Data

Apr. 11, 1990 [JP] Japan ..... 2-95919
Apr. 11, 1990 [JP] Japan ..... 2-95920

[51] Int. Cl.[5] ..... G03G 9/093

[52] U.S. Cl. ..... 430/138; 430/137; 430/109

[58] Field of Search ..... 430/137, 109, 138

[56] References Cited

U.S. PATENT DOCUMENTS

| | | | |
|---|---|---|---|
| 2,297,691 | 10/1942 | Carlson et al. | 95/5 |
| 2,357,809 | 9/1944 | Carlson et al. | 95/11 |
| 3,269,626 | 8/1966 | Albrecht et al. | 226/177 |
| 4,520,091 | 5/1985 | Kakimi et al. | 430/110 |
| 4,636,451 | 1/1987 | Matkin et al. | 430/109 |
| 4,833,057 | 5/1989 | Misawa et al. | 430/109 |
| 4,973,541 | 11/1990 | Kohri et al. | 430/111 |
| 4,977,052 | 12/1990 | Mikami | 430/98 |
| 5,037,716 | 8/1991 | Moffat | 430/109 |
| 5,082,757 | 1/1992 | Keoshkerian et al. | 430/106 |

FOREIGN PATENT DOCUMENTS

| | | |
|---|---|---|
| 2107892 | 5/1983 | United Kingdom . |
| 2135469 | 8/1984 | United Kingdom . |

OTHER PUBLICATIONS

European Search Report.

Progress in Organic Coatings, 3 (1975) 73-99, Wicks Jr. et al.

The Thermal Dissociation of Blocked Toluene Diisocyanates, vol. 1 No. 4 Dec. 1962 265-268, Griffin et al.

*Primary Examiner*—Marion E. McCamish
*Assistant Examiner*—Rosemary Ashton
*Attorney, Agent, or Firm*—Birch, Stewart, Kolasch & Birch

[57] ABSTRACT

An encapsulated toner for heat-and-pressure fixing which is composed of a heat-fusible core containing at least a coloring material and a shell formed so as to cover the surface of the core, wherein the main component of the shell is a resin prepared by reacting an iso(-thio)cyanate compound comprising (1) 0 to 30 mole % of monovalent isocyanate and/or isothiocyanate compounds and
(2) 100 to 70 mole % of at least divalent isocyanate and/or isothiocyanate compounds with an active hydrogen compound comprising
(3) 0 to 30 mole % of a compound having one active hydrogen atom reactive with isocyanate and/or isothiocyanate groups and
(4) 100 to 70 mole % of a compound having at least two active hydrogen atoms reactive with isocyanate and/or isothiocyanate groups at a molar ratio of the components (1) and (2) to the components (3) and (4) of between 1:1 and 1:20, and wherein at least 30% of the whole linkages in which an isocyanate or isothiocyanate group participates are thermally dissociating linkages. This toner is excellent in blocking resistance and triboelectric properties and enables low-energy fixing.

4 Claims, No Drawings

ENCAPSULATED TONER FOR HEAT-AND-PRESSURE FIXING

FIELD OF THE INVENTION

The present invention relates to an encapsulated toner for developing an electrostatic latent image formed in electrophotography, electrostatic printing or electrostatic recording. Particularly, the present invention relates to a toner for heat-and-pressure fixing.

DESCRIPTION OF THE PRIOR ART

A conventional electrophotographic process comprises, as described in U.S. Pat. Nos. 2,297,691 and 2,357,809, the step of uniformly charging a photoconductive insulating layer, exposing the charged layer to light to erase the charge in an exposed area to thereby form an electric latent image, visualizing the latent image by the adhesion thereto of a colored fine powder having a tribo electric charge which is called "toner" (i.e. the development step), transferring the visualized image to a transfer material such as a transfer paper (i.e. the transfer step), and permanently fixing the transferred image by heat, pressure or other proper means (i.e. the fixing step).

Therefore, a toner must satisfy the functions required not only in the development step, but also in the transfer and fixing steps.

Generally, a toner undergoes mechanical friction due to shearing and impact forces during the mechanical operation in a developing device to deteriorate after the repetition of copying from several thousand to several tens of thousand times Such deterioration of a toner can be prevented by using a tough resin having such a high molecular weight so as to withstand the above mechanical friction. However, this kind of resin generally has such a high softening point that the resulting toner cannot be sufficiently fixed by a non-contact method such as oven fixing or radiant fixing with infrared rays, because of poor thermal efficiency. Further, even when the toner is fixed by a heat-and-pressure fixing method using a heat roller or the like, which is a contact fixing method excellent in thermal efficiency and is therefore widely used, the temperature of the heat roller must be extremely enhanced in order to attain sufficient fixing thereof. This brings about disadvantages such as deterioration of the fixing device, curling of a paper and increase in energy consumption. Furthermore, the above resin is poor in grindability, which remarkably lowers the production efficiency of a toner. Accordingly, a resin having a sufficiently high degree of polymerization, i.e., too high a softening point cannot be used as a binder resin for a toner.

Meanwhile, according to the heat-and-pressure fixing method using a heat roller or the like, the surface of a heated roller comes into contact under pressure with the surface of a toner image formed on a transfer sheet, so that the fixing is excellent in thermal efficiency and therefore used widely in various copying machines of from a high-speed one to a low-speed one. However, when the surface of a heated roller is in contact with the surface of a toner image, the toner tends to cause a problem of adhering to the surface of the heated roller and being transferred to a subsequent transfer paper, i.e., a so called off-set or offset phenomenon In order to prevent this phenomenon, the roller is surfaced with a material excellent in release properties, such as a fluororesin, and a releasing agent such as silicone oil is further applied thereon. However, the application of a silicone oil or the like necessitates a larger-scale fixing device which is not only more expensive but also more complicated, which is causative of troubles disadvantageously.

Although processes for improving the offset resistance by unsymmetrizing or crosslinking the binder resin have been disclosed in Japanese Patent Publication No. 493/1982 and Japanese Patent Laid-Open Nos. 44836/1975 and 37353/1982, the fixing temperature could not be improved by these processes as yet.

Since the lowest fixing temperature of a toner is generally present between the temperature of low-temperature of the toner and that of high-temperature thereof, the serviceable temperature range of the toner is from the lowest fixing temperature to the temperature high-temperature. Accordingly, by lowering the lowest fixing temperature as much as possible and raising the temperature of causing high temperature as much as possible, the service fixing temperature can be lowered and the serviceable temperature range can be widened, which enables energy saving, high-speed fixing and prevention of a paper from curling.

From the above reasons, the development of a toner excellent in fixing properties and resistance has always been expected It has been proposed that the low-temperature fixing properties are improved by using a toner composed of a core and a shell formed so as to cover the surface of the core.

Among such toners, those having a core made of a low-melting wax which is easily deformable plastically (as described in U.S. Pat. No. 3,269,626, Japanese Patent Publication Nos. 15876/1971 and 9880/1969, and Japanese Patent Laid-Open Nos. 75032/1973 and 75033/1973) are poor in fixing strength and therefore can be used only in limited fields, though they can be fixed only by pressure.

Further, with respect to toners having a liquid core, when the strength of the shell is low, the toners tend to break in a developing device to stain the inside thereof, though they can be fixed only by pressure, while when the strength of the shell is high, a higher pressure is necessitated in order to break the capsule, thus giving too glossy images. Thus, it has been difficult to control the strength of the shell.

Further, there has been proposed a toner of a microcapsule type for heat-and-pressure fixing which is composed of a core made of a resin having a low glass transition which serves to enhance the fixing strength, though it will cause blocking at high temperature if used alone, and a high-melting resin shell formed by interfacial polymerization for the purpose of imparting blocking resistance to the toner (see Japanese Patent Laid-Open No. 56352/1986). However, this toner cannot fully exhibit the performance of the core, because the melting point of the shell is too high. On the same line of thinking as that described above, toners for heat roller fixing which are improved in the fixing strength of the core have been proposed (see Japanese Patent Laid-Open Nos. 128357/1988, 128358/1988, 128359/1988, 128360 /1988, 128361/1988 and 128362/1988). However, these toners must be prepared by spray drying to give a higher load to the equipment for the production thereof and, in addition, they cannot fully exhibit the performance of the core, because they are not improved in the shell material The present invention has been made under these circumstances and an object thereof is to provide a toner for heat-and-pressure fixing such as heat roller fixing which is excellent in offset resistance and fixable even at a low temperature and is excellent both in blocking resistance and in triboelectric properties to constantly give background-free images repeatedly.

Summary of the Invention

The inventors of the present invention have conducted intensive studies to solve the above problems and have accomplished-the present invention.

Namely, the present invention relates to an encapsulated toner or a capsulate toner for heat-and -pressure fixing which is composed of a heat-fusible core containing at least a coloring material and a shell formed so as to cover the surface of the core, wherein the main component of the shell is a resin prepared by reacting an iso(thio)cyanate compound comprising (1) 0 to 30 mole % of monovalent isocyanate and/or isothiocyanate compounds and (2) 100 to 70 mole % of at least divalent isocyanate and/or isothiocyanate compounds with an active hydrogen compound comprising (3) 0 to 30 mole % of a compound having one active hydrogen atom reactive with isocyanate and/or isothiocyanate groups and (4) 100 to 70 mole % of a compound having at least two active hydrogen atoms reactive with isocyanate and/or isothiocyanate groups at a molar ratio of the components (1) and (2) to the components (3) and (4) of between 1:1 and 1:20, and wherein at least 30% of the whole linkages in which an isocyanate or isothiocyanate group participates are thermally dissociating linkages.

According to the present invention, it is preferable that the thermally dissociating linkage be one formed by the reaction between a phenolic hydroxyl or thiol group and an isocyanate or isothiocyanate group. Further, when the main component of the heat-fusible core of the toner according to the present invention is a thermoplastic resin, the glass transition temperature or point assignable to the resin is 10° to 50° C. and the softening point of the toner is 80° to 150° C., more excellent characteristics can be exhibited.

According to the present invention, it is preferable that the thermally dissociating linkage be one formed by the reaction between a phenolic or thiol group and isocyanate or isothiocyanate group, for example, a thermally dissociating urethane linkage which dissociates into an isocyanate group and a hydroxyl group at a certain temperature and is well known in the field of coating materials as "blocked isocyanate".

The blocking of polyisocyanates is well known as a means for temporarily inhibiting the reaction between an isocyanate group and an active hydrogen compound and various blocking agents such as tertiary alcohols, phenols, acetoacetates and ethyl malonate are disclosed in, for example, Z. W. Wicks, Jr., Prog. in Org. Coatings, 3, 73 (1975).

It is preferable and essential that the thermally dissociating polyurethane to be used in the present invention have a low thermal dissociation temperature. As understood from the results described in, e.g., G. R. Grittin and L. J. Willwerth, Ind. Eng. Chem. Prod. Res. Develop., 1, 265 (1962), among various urethane linkages, a resin having a urethane linkage formed by the reaction between an isocyanate compound and a phenolic hydroxyl group exhibits a low thermal dissociation temperature and therefore is used favorably.

Thermal dissociation is an equilibrium reaction and, for example, the reaction represented by the following formula is known to proceed from the right to the left with an increasing temperature:

$$O{=}C{=}N{-}N{=}C{=}O + 2ArOH \rightleftharpoons ArO\overset{\overset{\displaystyle O}{\|}}{C}NH{-}NH\overset{\overset{\displaystyle O}{\|}}{C}OAr$$

(wherein Ar represents an aromatic group)

Examples of the monovalent isocyanate compound to be used as the component (1) in the present invention include ethyl isocyanate, octyl isocyanate, 2-chloroethyl isocyanate, chlorosufonyl isocyanate, cyclohexyl isocyanate, n-dodecyl isocyanate, butyl isocyanate, n-hexyl isocyanate, lauryl isocyanate, phenyl isocyanate, m-chlorophenyl isocyanate, 4-chlorophenyl isocyanate, p-cyanophenyl isocyanate, 3,4-dichlorophenyl isocyanate, o-tolyl isocyanate, m-tolyl isocyanate, p-tolyl isocyanate, p-toluenesulfonyl isocyanate, 1-naphthyl isocyanate, o-nitrophenyl isocyanate, m-nitrophenyl isocyanate, p-nitrophenyl isocyanate, phenyl isocyanate, p-bromophenyl isocyanate, o-methoxyphenyl isocyanate, m-methoxyphenyl isocyanate, p-methoxyphenyl isocyanate, ethyl isocyanatoacetate, butyl isocyanatoacetate and trichloroacetyl isocyanate.

Examples of the divalent or higher isocyanate compound to be used as the component (2) in the present invention include aromatic isocyanate compounds such as 2,4-tolylene diisocyanate, 2,4-tolylene diisocyanate dimer, 2,6-tolylene diisocyanate, p-xylylene diisocyanate, m-xylylene diisocyanate, 4,4'-diphenylmethane diisocyanate, 1,5-naphthylene diisocyanate, 3,3'-dimethyldiphenyl-4,4'-diisocyanate, 3,3'-dimethyldiphenylmethane-4,4'-diisocyanate, m-phenylene diisocyanate, triphenylmethane triisocyanate and polymethylenephenyl isocyanate; aliphatic isocyanate compounds such as hexamethylene diisocyanate, trimethylhexamethylene diisocyanate, lysine diisocyanate and dimer acid diisocyanates; alicyclic isocyanate compounds such as isophorone diisocyanate, 4,4'-methylenebis(cyclohexyl isocyanate), methylcyclohexane-2,4 (or 2,6)-diisocyanate and 1,3-(isocyanatomethyl)cyclohexane; and other isocyanate compounds such as an adduct of 1 mol of trimethylolpropane with 3 mol of tolylene diisocyanate.

Examples of the isothiocyanate compound include phenyl isothiocyanate, xylylene-1,4 diisothiocyanate and ethylidene diisocthiocyanate.

Among these isocyanate and isothiocyanate compounds, a compound having an isocyanate group directly bonded to an aromatic ring is effective in forming a urethane resin having a low thermal dissociation temperature and therefore is preferably used in the present invention.

According to the present invention, the monovalent isocyanate or isothiocyanate compound (1) also serves as a molecular weight modifier for the shell-forming resin and can be used in an amount of at most 30 mole % based on the iso(thio)cyanate component. When the amount exceeds 30 mole %, the storage stability of the obtained toner will be poor unfavorably.

Examples of the compound having one active hydrogen atom reactive with isocyanate and/or isothiocyanate groups to be used as the component (3) in the present invention include aliphatic alcohols such as methyl alcohol, ethyl alcohol, propyl alcohol, isopropyl alcohol, butyl alcohol, isobutyl alcohol, t-butyl alcohol, pentyl alcohol, hexyl alcohol, cyclohexyl alcohol, heptyl alcohol, octyl alcohol, nonyl alcohol, decyl alcohol, lauryl alcohol and stearyl alcohol; aromatic alcohols such as phenol, o-cresol, m-cresol, p-cresol, 4-butylphenol, 2-sec-butylphenol, 2-tert-butylphenol, 3-tert-butylphenol, 4-tert-butylphenol, nonylphenol, isononylphenol, 2-propenylphenol, 3-propenylphenol, 4-propenylphenol, 2-methoxyphenol, 3-methoxyphenol, 4-methoxyphenol, 3-acetylphenol, 3-carbomethoxyphenol, 2-chlorophenol, 3-chlorophenol, 4-chlorophenol, 2-bromophenol, 3-bromophenol, 4-bromophenol, benzyl alcohol, 1-naphthol, 2-naphthol and 2-acetyl-1-naphthol; and amides such as ε-caprolactam.

Particularly, it is preferable to use a phenol derivative represented by the following formula (I):

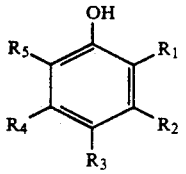

(I)

wherein $R_1$, $R_2$, $R_3$, $R_4$ and $R_5$ each independently represent a hydrogen atom, an alkyl group having 1 to carbon atoms, an alkenyl, alkoxy, alkanoyl, carboalkoxy or aryl group or a halogen atom.

Examples of the dihydric or higher alcohol among the compounds having at least two active hydrogen atoms reactive with isocyanate and/or isothiocyanate groups to be used as the component (4) in the present invention include catechol, resorcinol, hydroquinone, 4-methylcatechol, 4-t-butylcatechol, 4-acetylcatechol, 3-methoxycatechol, 4-phenylcatechol, 4-methylresorcinol, 4-ethylresorcinol, 4-t-butylresorcinol, 4-hexylresorcinol, 4-chlororesorcinol, 4-benzylresorcinol, 4-acetylresorcinol, 4-carbomethoxyresorcinol, 2-methylresorcinol, 5-methylresorcinol, t-butylhydroquinone, 2,5-di-t-butylhydroquinone, 2,5-di-t-amylhydroquinone, tetramethylhydroquinone, tetrachlorohydroquinone, methylcarboaminohydroquinone, methylureidohydroquinone, benzonorbornene-3,6-diol, bisphenol A, bisphenol S, 3,3'-dichlorobisphenol S, 2,2'-dihydroxybenzophenone, 2,4-dihydroxybenzophenone, 4,4'-dihydroxybenzophenone, 2,2'-dihydroxydiphenyl, 4,4'-dihydroxydiphenyl, 2,2'-dihydroxydiphenylmethane, 3,4-bis(p-hydroxyphenyl)hexane, 1,4-bis(2-(p-hydroxyphenyl)propyl)benzene, bis(4-hydroxyphenyl)methylamine, 1,3-dihydroxynaphthalene, 1,4-dihydroxynaphthalene, 1,5-dihydroxynaphthalene, 2,6-dihydroxynaphthalene, 1,5-dihydroxyanthraquinone, 2-hydroxybenzyl alcohol, 4-hydroxybenzyl alcohol, 2-hydroxy-3,5-di-t-butylbenzyl alcohol, 4-hydroxy-3,5-di-t-butylbenzyl alcohol, 4-hydroxyphenethyl alcohol, 2-hydroxyethyl 4-hydroxybenzoate, 2-hydroxyethyl 4-hydroxyphenylacetate, resorcinol mono-2-hydroxyethyl ether, hydroxyhydroquinone, gallic acid and ethyl 3,4,5-trihydroxybenzoate. Particularly, catechol derivatives represented by the following formula (II) and resorcinol derivatives represented by the following formula (III) are preferably used:

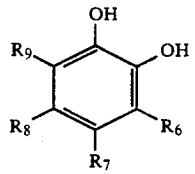

(II)

wherein $R_6$, $R_7$, $R_8$ and $R_9$ each independently represent a hydrogen atom, an alkyl group having 1 to 6 carbon atoms, an alkenyl, alkoxy, alkanoyl, carboalkoxy or aryl group or a halogen atom,

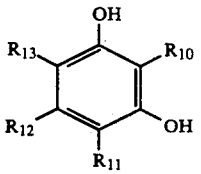

(III)

wherein $R_{10}$, $R_{11}$, $R_{12}$ and $R_{13}$ each independently represent a hydrogen atom, an alkyl group having 1 to 6 carbon atoms, an alkenyl, alkoxy, alkanoyl, carboalkoxy or aryl group or a halogen atom.

Further, examples of the compound having at least one isocyanate- or isothiocyanate-reactive functional group other than the hydroxyl group and at least one phenolic hydroxyl group include o-hydroxybenzoic acid, m-hydroxybenzoic acid, p-hydroxybenzoic acid, 5-bromo-2-hydroxybenzoic acid, 3-chloro-4-hydroxybenzoic acid, 4-chloro-2-hydroxybenzoic acid, 5-chloro-2-hydroxybenzoic acid, 3,5-dichloro-4-hydroxybenzoic acid, 3-methyl-2-hydroxybenzoic acid, 5-methoxy-2-hydroxybenzoic acid, 3,5-di-t-butyl-4-hydroxybenzoic acid, 4-amino-2-hydroxybenzoic acid, 5-amino-2-hydroxybenzoic acid, 2,5-dinitrosalicylic acid, sulfosalicylic acid, 4-hydroxy-3-methoxyphenylacetic acid, catechol-4-carboxylic acid, 2,4-dihydroxybenzoic acid, 2,5-dihydroxybenzoic acid, 2,6-dihydroxybenzoic acid, 3,4-dihydroxybenzoic acid, 3,5-dihydroxybenzoic acid, 3,4-dihydroxyphenylacetic acid, m-hydroxycinnamic acid, p-hydroxycinnamic acid, 2-amino-4-methylphenol, 2-amino-5-methylphenol, 5-amino-2-methylphenol, 3-amino-2-naphthol, 8-amino-2-naphthol, 1-amino-2-naphthol-4-sulfonic acid, 2-amino-5-naphthol-4-sulfonic acid, 2-amino-4-nitrophenol, 4-amino-2-nitrophenol, 4-amino-2,6-dichlorophenol, o-aminophenol, m-aminophenol, p-aminophenol, 4-chloro-2-aminophenol, 1-amino-4-hydroxyanthraquinone, 5-chloro-2-hydroxyaniline, α-cyano-3-hydroxycinnamic acid, α-cyano-4-hydroxycinnamic acid, 1-hydroxynaphthoic acid, 2-hydroxynaphthoic acid, 3-hydroxynaphthoic acid and 4-hydroxyphthalic acid.

Further, examples of the polythiol compound having at least one thiol group in its molecule include ethanethiol, 1-propanethiol, 2-propanethiol, thiophenol, bis(2-mercaptoethyl) ether, 1,2-ethanedithiol, 1,4-butanedithiol, bis(2-mercaptoethyl) sulfide, ethylene glycol bis(2-mercaptoacetate), ethylene glycol bis(3-mercaptopropionate), 2,2-dimethylpropanediol bis(2-mercaptoacetate), 2,2-dimethylpropanediol bis(3-mercaptopropionate), trimethylolpropane tris(2-mercaptoacetate), trimethylolpropane tris(3-mercaptopropionate), trimethylolethane tris(2-mercaptoacetate), trimethylolethane tris(3-mercaptopropionate), pentaerythritol tetrakis(2-mercaptoacetate), pentaerythritol tetrakis(3-mercaptopropionate), dipentaerythritol hexakis(2-mercaptoacetate), dipentaerythritol hexakis(3-mercaptopropionate), 1,2-dimercaptobenzene, 4-methyl-1,2-dimercaptobenzene, 3,6-dichloro-1,2-dimercaptobenzene, 3,4,5,6-tetrachloro-1,2-dimercaptobenzene, xylylenedithiol and 1,3,5-tris(3-mercaptopropyl) isocyanurate.

In the thermally dissociating shell-forming resin according to the present invention, at least 30%, preferably at least 50% of the whole linkages in which an isocyanate or isothiocyanate group participates are thermally dissociating linkages. When the content of the thermally dissociating linkages is less than 30%, the strength of the shell will not be sufficiently lowered in the heat-and-pressure fixing, so that any excellent fixing performance of the core will not be fully exhibited.

According to the present invention, other compounds having an isocyanate-reactive functional group other than phenolic hydroxyl and thiol groups, for example, the following active methylene compounds such as malonate or acetoacetate, oxime such as methyl ethyl ketone oxime, carboxylic acid, polyol, polyamine, aminocarboxylic acid or aminoalcohol, may be used as a shell-forming material in such an amount as not to lower the ratio of the linkages formed by the reaction of isocyanate and/or isothiocyanate groups with phenolic hydroxyl and/or thiol groups to the whole linkages in which an isocyanate or isothiocyanate group participates to less than 30%.

The active methylene compound includes malonic acid, monomethyl malonate, monoethyl malonate, isopropyl malonate, dimethyl malonate, diethyl malonate diisopropyl malonate, tert-butyl ethyl malonate, malonamide, acetylacetone, methyl acetoacetate, ethyl acetoacetate, tert-butyl acetoacetate and allyl acetoacetate.

The carboxylic acid includes monocarboxylic acids such as acetic, propionic, butyric, isobutyric, pentanoic, hexanoic and benzoic acids; dicarboxylic acids such as maleic, fumaric, citraconic, itaconic, glutaconic, phthalic, isophthalic, terephthalic, succinic, adipic, sebacic, azelaic, malonic, n-dodecenylsuccinic, isododecenylsuccinic, n-dodecylsuccinic, isododecylsuccinic, n-octenylsuccinic and n-octylsuccinic acids; and tribasic and higher carboxylic acids such as 1,2,4-benzenetricarboxylic, 2,5,7-naphthalenetricarboxylic, 1,2,4-naphthalenetricarboxylic, 1,2,4-butanetricarboxylic and 1 2,5 -hexanetricarboxylic acids, 1,3-dicarboxyl-2-methyl-2-methylenecarboxypropane, 1,2,4-cyclohexanetricarboxylic acid, tetra(methylenecarboxy)methane, 1,2,7,8-octanetetracarboxylic acid, pyromellitic acid and Empol trimer acid.

Examples of the polyol include diols such as ethylene glycol, propylene glycol, butylene glycol, neopentyl glycol, hexamethylene glycol, diethylene glycol and dipropylene glycol; triols such as glycerol, trimethylolpropane, trimethylolethane and 1,2,6-hexanetriol; pentaerythritol and water, while those of the polyamine include ethylenediamine, hexamethylenediamine, diethylenetriamine, iminobispropylamine, phenylenediamine, xylylenediamine and triethylenetetramine.

According to the present invention, the compound having one active hydrogen atom reactive with isocyanate and/or isothiocyanate groups as the component (3) may be used in an amount of at most 30 mole % based on the active hydrogen component. When the amount exceeds 30 mole %, the storage stability of the resulting toner will be poor unfavorably.

Further, it is preferable in order to obtain a resin free from unreacted isocyanate groups that the molar ratio of the iso(thio)cyanate compound comprising the components (1) and (2) to the active hydrogen compounds comprising the components (3) and (4) lie between 1:1 and 1:20.

In the preparation of the toner according to the present invention, the shell is preferably formed by interfacial polymerization or in situ polymerization. Alternatively, it may be formed by a dry process comprising stirring a matrix particle as a core together with a particle of a shell-forming material having a number-average particle diameter of one-eighth or below of that of the matrix particle in a stream of air at a high rate.

Although the shell-forming resin can be prepared in the absence of any catalyst, it may be prepared in the presence of a catalyst. The catalyst may be any conventional one used for the preparation of urethanes and includes tin catalysts such as dibutyltin dilaurate and amine catalysts such as 1,4-diazabicyclo[2.2.2]octane and N,N,N-tris-(dimethylaminopropyl)-hexahydro-s-triazine.

The resin to be used as a core material of the capsule toner according to the present invention is a thermoplastic resin having a glass transition (Tg) of 10° to 50° C. and examples thereof include polyester, polyesterpolyamide, polyamide and vinyl resins, among which vinyl resins are particularly preferable.

Examples of the monomer constituting the vinyl resin include styrene and its derivatives such as styrene, o-methylstyrene, m-methylstyrene, p-methylstyrene, α-methylstyreney p-ethylstyrene, 2,4-dimethylstyrene, p-chlorostyrene and vinylnaphthalene; ethylenically unsaturated monoolefins such as ethylene, propylene, butylene and isobutylene; vinyl esters such as vinyl chloride, vinyl bromide, vinyl fluoride, vinyl acetate, vinyl propionate, vinyl formate and vinyl caproate; ethylenic monocarboxylic acids and esters thereof such as acrylic acid, methyl acrylate, ethyl acrylate, n-propyl acrylate, isopropyl acrylate, n-butyl acrylate, isobutyl acrylate, t-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl α-chloroacrylate, methacrylic acid, methyl methacrylate, ethyl methacrylate, n-propyl methacrylate, isopropyl methacrylate, n-butyl methacrylate, isobutyl methacrylate, t-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate and diethylaminoethyl methacrylate; ethylenic monocarboxylic acid derivatives such as acrylonitrile, methacrylonitrile and acrylamide; ethylenic dicarboxylic acids and derivatives thereof such as dimethyl maleate; vinyl ketones such as vinyl methyl ketone; vinyl ethers such as vinyl methyl ether; vinylidene halides such as vinylidene chloride; and N-vinyl compounds such as N-vinylpyrrole and N-vinylpyrrolidone.

Among the above core resin-constituting monomers, it is preferable that the core-forming resin contain styrene or its derivative still preferably in an amount of 50 to 90 parts by weight for forming the main skeleton of the resin and an ethylenic monocarboxylic acid or an ester thereof still preferably in an amount of 10 to 50 parts by weight for controlling the thermal characteristics of the resin such as a softening point.

When the monomer composition constituting the core-forming resin according to the present invention contains a crosslinking agent, the crosslinking agent may be suitably selected from among divinylbenzene, divinylnaphthalene, polyethylene glycol dimethacrylate, diethylene glycol diacrylate, triethylene glycol diacrylate, 1,3-butylene glycol dimethacrylate, 1,6-hexylene glycol dimethacrylate, neopentyl glycol dimethacrylate, dipropylene glycol dimethacrylate, polypropylene glycol dimethacrylate, 2,2'-bis(4-methacryloxydiethoxyphenyl)propane, 2,2'-bis(4-acryloxy diethoxyphenyl)propane, trimethylolpropane trimethacrylate, trimethylolpropane triacrylate, tetramethylolmethane tetraacrylate, dibromoneopentyl glycol dimethacrylate and diallyl phthalate, which may be also used as a mixture of two or more of them.

If the amount of the crosslinking agent added is too large, the resulting toner will be difficultly heat-fusible to give poor heat fixability and heat-and-pressure fixability. On the contrary, if the amount is too small, in heat-and-pressure fixing, a part of the toner will not be fixed on a paper completely but adhere to the surface of a roller, and will transfer to the subsequent paper, i.e., a so-called off-set or offset phenomenon will be hardly prevented. Accordingly, the amount of the crosslinking agent to be added is preferably 0.001 to 15% by weight (still preferably 0.1 to 10% by weight) based on the monomers used.

A graft or crosslinked polymer prepared by polymerizing the above monomers in the presence of an unsaturated polyester may be also used as the resin for the core.

Examples of the polymerization initiator to be used in the preparation of the vinyl resin include azo and diazo polymerization initiators such as 2,2'-azobis(2,4-dimethylvaleronitrile), 2,2'-azobis-isobutyronitrile, 1,1'-azobis(cyclohexane-1-carbonitrile) and 2,2'-azobis-4-methoxy-2,4-dimethylvaleronitrile; and peroxide polymerization initiators such as benzoyl peroxide, methyl ethyl ketone peroxide, isopropyl peroxycarbonate, cumene hydroperoxide, 2,4-dichlorobenzoyl peroxide, lauroyl peroxide and dicumyl peroxide.

Two or more polymerization initiators may be used mixedly for the purpose of controlling the molecular weight or molecular weight distribution of the polymer or the reaction time.

The amount of the polymerization initiator to be used is 0.1 to 20 parts by weight, preferably 1 to 10 parts by weight per 100 parts by weight of the monomers to be polymerized.

The core may contain one or more arbitrary inhibitors for the purpose of improving the resistance in heat-and-pressure fixing and examples of the offset inhibitor include polyolefins, metal salts of fatty acids, fatty acid esters, partially saponified fatty acid esters, higher fatty acids, higher alcohols, paraffin waxes, amide waxes, polyhydric alcohol esters, silicone varnish, aliphatic fluorocarbons and silicone oils.

The above polyolefin is a resin selected from among polypropylene, polyethylene, polybutene and so on and having a softening point of 80 to 160° C. The above metal salt of fatty acid includes salts of maleic acid with zinc, magnesium or calcium; those of stearic acid with zinc, cadmium, barium, lead, iron, nickel, cobalt, copper, aluminum or magnesium; dibasic lead stearate; salts of oleic acid with zinc, magnesium, iron, cobalt, copper, lead or calcium; those of palmitic acid with aluminum or calcium; caprylates; lead caproate; salts of linoleic acid with zinc or cobalt; calcium ricinoleate; salts of ricinoleic acid with zinc or cadmium; and mixtures thereof. The above fatty acid ester includes ethyl maleate, butyl maleate, methyl stearate, butyl stearate, cetyl palmitate and ethylene glycol montanate. The above partially saponified fatty acid ester includes partially calcium-saponified montanate. The above higher fatty acid includes dodecanoic, lauric, myristic, palmitic, stearic, oleic, linoleic, ricinoleic, arachic, behenic, lignoceric and selacholeic acids and mixtures of them. The above higher alcohol includes dodecyl, lauryl, myristyl, palmityl, stearyl, arachyl and behenyl alcohols. The above paraffin wax includes natural paraffins, microwax, synthetic paraffin and chlorinated hydrocarbons. The above, amide wax includes stearamide, oleamide, palmitamide, lauramide, behenamide, methylenebisstearamide and ethylenebisstearamide, N,N'-m-xylylenebisstearamide, N,N'-m-xylylenebis-12-hydroxystearamide, N,N'-isophthalic bisstearylamide and N,N'-isophthalic bis-12-hydroxystearylamide. The above polyhydric alcohol ester includes glycerol stearate, glycerol ricinolate, glycerol monobehenate, sorbitan monostearate, propylene glycol monostearate and sorbitan trioleate. The above silicone varnish includes methylsilicone varnish and phenylsilicone varnish. The above aliphatic fluorocarbon includes oligomers of tetrafluoroethylene or hexafluoropropylene and fluorinated surfactants disclosed in Japanese Patent Laid-Open No. 124428/1978.

When the shell of the toner is formed by interfacial or in situ polymerization, however, the use of a large amount of a compound having an isocyanate-reactive functional group, for example a higher fatty acid or higher alcohol, is not desirable, because the formation of the shell is hindered.

It is preferable to use an offset inhibitor as described above in an amount of 1 to 20% by weight based on the resin contained in the core.

In the present invention, the core of the toner contains a coloring material, which may be any one selected from among the dyes and pigments for toner according to the prior art.

The coloring material to be used in the present invention includes various carbon blacks such as thermal black, acetylene black, channel black, lamp black; resin-coated carbon blacks, i.e., grafted carbon black; nigrosine dye, Phthalocyanine Blue, Permanent Brown FG, Brilliant Fast Scarlet, Pigment Green B, Rhodamine B Base, Solvent Red 49, Solvent Red 146, Solvent Blue 35 and mixtures of them. The coloring material is generally used in an amount of 1 to 15 parts by weight per 100 parts by weight of the resin contained in the core.

According to the present invention, a magnetic toner can be prepared by adding a particulate magnetic material to the core. The particulate magnetic material includes ferromagnetic metals such as iron, cobalt and nickel, and alloys and compounds thereof such as ferrite and magnetite; alloys which become ferromagnetic by suitable thermal treatment through not contain any ferromagnetic element, for example, alloys containing manganese and copper, called "Heusler alloy", such as manganese/copper/aluminum and manganes/copper/-tin alloys; chromium dioxide and others. Such a magnetic material is uniformly dispersed in the core in a state of a fine powder having a mean particle diameter of 0.1 to 1 μm. The amount of the magnetic material is 20 to 70 parts by weight, preferably 30 to 70 parts by weight per 100 parts by weight of the toner.

When a particulate magnetic material is incorporated into the core in order to obtain a magnetic toner, the material may be treated in a similar manner to that of the coloring material. Since a particulate magnetic material is poor as such in the affinity for organic substances such as core materials and monomers, the material is used together with a coupling agent or is treated therewith prior to the use to thereby enable the uniform dispersion thereof, the coupling agent including titanium, silane and lecithin coupling agents.

When the toner is prepared by interfacial or in situ polymerization, the shell-forming materials and the core-forming materials are dispersed in a dispersion medium. In this step, it is necessary to incorporate a dispersant into the medium for the purpose of preventing the agglomeration and aggregation of the dispersoids.

Examples of the dispersant include gelatin, gelatin derivatives, polyvinyl alcohol, polystyrenesulfonic acid, hydroxymethylcellulose, hydroxyethylcellulose, hydroxypropylcellulose, sodium carboxymethyl cellulose, polysodium acrylate, sodium dodecylbenzenesulfonate, sodium tetradecyl sulfate, sodium pentadecyl sulfate, sodium octyl sulfate, sodium allyl alkyl polyethersulfonate, sodium oleate, sodium laurate, sodium caprate, sodium caprylate, sodium caproate, potassium stearate, calcium oleate, sodium 3,3-disulfonediphenylurea-4,4-diazobisamino-β-naphthol-6-sulfonate, o-carboxybenzeneazodimethylaniline, sodium 2,2,5,5-tetramethyltriphenylmethane-4,4-diazobis-8-naphthol-disulfonate, colloidal silica, alumina, tricalcium phosphate, ferric hydroxide, titanium hydroxide, aluminum hydroxide and others, which may be also used as a mixture of two or more of them.

The dispersion medium for the above dispersant includes water, methanol, ethanol, propanol, butanol, ethylene glycol, glycerin, acetonitrile, acetone, isopropyl ether, tetrahydrofuran and dioxane. These media may be used either alone or as a mixture of two or more of them.

According to the present invention, a metal-containing dye which has been used for toners, for example, a metal complex of an organic compound having a carboxyl or nitrogenous group, such as nigrosine, may be added to the shell-forming materials in a proper amount as a charge control agent. Alternatively, such a charge control agent may be mixed with the toner.

According to the present invention, it is preferable that the heat-fusible core be made of a thermoplastic resin and the glass transition assignable to the resin be 10° to 50° C. If the glass transition is lower than 10° C., the resulting toner will be poor in storage stability, while if it exceeds 50° C., the resulting toner will be poor in fixing strength unfavorably. The term "glass transition" used in this specification refers to the temperature of an intersection of the extension of the base line below the glass transition and the tangential line having the maximum inclination between the kickoff of the peak and the top thereof as determined with a differential scanning calorimeter (mfd. by Seiko Instruments Inc.) at a temperature rise rate of 10° C./min.

It is preferable that the toner of the present invention have a softening point of 80° to 150° C. If the softening point is lower than 80° C., the resistance will be poor unfavorably, while if it exceeds 150° C., the fixing strength will be poor unfavorably. The term "softening point" used in this specification refers to the temperature corresponding to one half of the height (h) of the S-shaped curve showing a relationship between the downward movement of a plunger (flow rate) and temperature, which is given by extruding 1 $cm^3$ of a sample through a nozzle having a diameter of 1 mm and a length of 1 mm with a Koka type flow tester (mfd. by Shimadzu Corporation), while heating the sample so as to raise the temperature at a rate of 6° C./min and applying a load of 20 $kg/cm^2$ thereto with the plunger.

Although the particle diameter of the toner according to the present invention is not particularly limited, the mean particle diameter thereof is generally 3 to 30 μm. It is preferable that the thickness of the shell of the toner be 0.01 to 1 μm. When the thickness is less than 0.01 μm, the blocking resistance will be poor, while when it exceeds 1 μm, the heat fusibility will be poor unfavorably.

If necessary, a fluidity improver and/or a cleanability improver may be used for the capsulate toner of the present invention. Examples of the fluidity improver include silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide and silicon nitride, among which finely powdered silica is particularly preferable.

The finely powdered silica is a fine powder having Si-O-Si linkages, which may be prepared by either the dry or wet process. Although the finely powdered silica may be any one selected from among aluminum silicate, sodium silicate, potassium silicate, magnesium silicate and zinc silicate, it is preferable that at least 85% by weight of $SiO_2$ be contained therein. Further, finely powdered silica surface-treated with a silane or titanium coupling agent, silicone oil optionally having an amino side chain, or the like may be also used.

The cleanability improver includes metal salts of higher fatty acids represented by zinc stearate; and fine-powders of fluorocarbon polymers.

Further, it is possible to use an additive for controlling the developability of the toner, for example, finely powdered polymethyl methacrylate.

Furthermore, a small amount of carbon black may be used for toning or resistance control. The carbon black may be any one selected from among various known ones such as furnace black, channel black and acetylene black.

When the toner of the present invention contains a particulate magnetic material, it can be used alone as a developer, while when the toner does not contain any particulate magnetic material, the toner can be used as a binary developer comprising it and a carrier. Although the carrier is not particularly limited, it includes iron powder, ferrite, glass bead and so on, which may be coated with resins.

The ratio of the toner to the carrier is 0.5 to 10% by weight. The particle diameter of the carrier is 30 to 500 μm.

When the toner of the present invention is fixed on a recording medium such as paper by the simultaneous application of heat and pressure, an excellent fixing strength is attained. The heat-and-pressure fixing process to be suitably used in the fixing of the toner of the present invention may be any one wherein both heat and pressure are utilized. Examples thereof include known heat roller fixing, a fixing process as described in Japanese Patent Laid-Open No. 190870/1990 which comprises fusing toner images present on a recording medium in an unfixed state by heating the toner images with a heating mean constituted of a heater and a heat-resistant sheet through the heat-resistant sheet to thereby fix the toner images on the medium, and a heat-and-pressure process as described in Japanese Patent Laid-Open No. 162356/1990 which comprises fixing developed toner images on a recording medium with the use of a heating element fixed to a support and a pressing member which faces the heating element and brings the recording medium into close contact with the heating element through a film under pressure.

The toner for heat-and-pressure fixing according to the present invention has a shell mainly made of a resin having a thermally dissociating linkage and therefore exhibits excellent blocking resistance and triboelectric properties by virtue of the shell. Further, the shell is weakened by the heat applied in the fixing step to become easily breakable by pressing, so that the excellent fixing properties of the core having a low thermal deformation temperature can be exhibited sufficiently to enable low-energy fixing.

EXAMPLE

The Examples of the present invention will now be given, though the embodiments of the present invention are not limited by them.

EXAMPLE 1

10.0 parts by weight of carbon black "#44" (a product of Mitsubishi Chemical Industries, Ltd.), 4.0 parts by weight of 4,4'-diphenylmethane diisocyanate parts by weight of 4,4'-diphenyLmethane diisocyanate "Millionate MT" (a product of Nippon Polyurethane Industry Co., Ltd.) were added to a mixture comprising 70.0 parts by weight of styrene, 30.0 parts by weight of 2-ethylhexyl acrylate and 1.0 part by weight of divinylbenzene. The obtained mixture was thrown into an attritor (mfd. by Mitsui Miike Kakoki) and dispersed at 10° C. for 5 hours to give a polymerizable composition. This composition was added to 800 g of a by weight aqueous colloidal solution of tricalcium phosphate which had been preliminarily prepared in a 2-l separable glass flask so as to give a concentration of 30% by weight. The obtained mixture was emulsified and dispersed with a TK homomixer (a mfd. by Tokushu, Kika Kogyo) at 5° C. and a rotational speed of 10000 rpm for 2 minutes. A four-necked glass cap was set on the flask and a reflux condenser, a thermometer, a dropping funnel fitted with a nitrogen inlet tube and a stainless steel stirring rod were set thereon. The resulting flask was placed in an electric mantle heater. A solution of 22.0 g of resorcinol, 3.6 g of diethyl malonate and 0.5 g of 1,4-diazabicyclo[2.2.2]octane in 40 g of ion-exchanged water was dropped into the flask through the dropping funnel under stirring over a period of 30 minutes. Thereafter, the contents were heated to 80° C. and reacted for 10 hours in a nitrogen atmosphere under stirring. The reaction mixture was cooled and the dispersant was dissolved with 10% aqueous hydrochloricacid. The resulting mixture was filtered and the obtained solid was washed with water, dried under a reduced pressure of 20 mmHg at 45° C. for 12 hours and classified with an air classifier to give toner of a mean particle diameter of 9 μm having a shell made of a resin having a thermally dissociating urethane linkage.

0.4 part by weight of hydrophobic silica powder "Aerosil R-972" (a product of Aerosil) was mixed with 100 parts by weight of the above toner to give toner according to the present invention. This toner will be referred to as "Toner 1". The glass transition assignable to the resin contained in the core was 30.2° C. and the softening point of Toner 1 was 130.0° C.

EXAMPLE 2

100 parts by weight of a copolymer comprising 75 parts by weight of styrene and 25 parts by weight of n-butyl acrylate and having a softening point of 75.3° C. and a glass transition point of 40.5° C., 6 parts by weight of copper phthalocyanine "Sumikaprint Cyanine Blue GN-0" (a product of Sumitomo Chemical Co., Ltd.) and 5 parts by weight of polypropylene wax "Biscol 550p" (a product of Sanyo Chemical Industries, Ltd.) were together premixed, melt-kneaded in a twin-screw extruder, cooled and pulverized. 40 Parts by weight of this kneaded mixture was mixed with 50 parts by weight of styrene, 15 parts by weight of n-butyl acrylate, 3 parts by weight of 2,2'-azobis(2,4-dimethylvaleronitrile), 9.0 parts by weight of an adduct of 3 mol of 2,4-tolylene diisocyanate with 1 mol of trimethylolpropane "Takenate D-102" (a product of Takeda Chemical Industries, Ltd.) and 0.5 part of xylylene-1,4 diisothiocyanate to give a polymerizable composition. This composition was added to 800 g of a 4% by weight aqueous colloidal solution of tricalcium phosphate preliminarily prepared in a 2-l separable glass flask so as to give a concentration of 30% by weight. The contents were emulsified and dispersed with a TK homomixer at 5° C. and a rotational speed of 10000 rpm for 2 minutes.

A four-necked glass cap was set on the flask, and a reflux condenser, a thermometer, a dropping funnel fitted with a nitrogen inlet tube and a stainless steel stirring rod were set thereon. The resulting flask was placed in an electric mantle heater. A solution of 27.4 g of 4-acetylcatechol, 4.0 g of dimethyl malonate, 0.8 g of 1,2-ethanediol and 0.5 g of 1,4-diazabicyclo[2.2.2]octane in 40 g of ion-exchanged water was dropped into the flask through the dropping funnel under stirring over a period of 30 minutes. While stirring the contents in a nitrogen atmosphere, the contents were heated to 80° C. and reacted for 10 hours. The reaction mixture was cooled and the dispersant was dissolved with 10% aqueous hydrochloric acid. The resulting mixture was filtered and the obtained solid was washed with water, dried at 45° C. under a reduced pressure of 20 mmHg for 12 hours and classified with an air classifier to give a toner of a mean particle diameter of 9 μm having a shell made of a resin having a thermally dissociating urethane and thiourethane linkage.

0.4 part by weight of hydrophobic silica powder "Aerosil R-972" (a product of Aerosil) was mixed with 100 parts by weight of the above toner to give toner according to the present invention. This toner will be referred to as "Toner 2". The glass transition assignable to the resin contained in the core was 35.4° C. and the softening point of Toner 2 was 133.5° C.

EXAMPLE 3

40 parts by weight of styrene-grafted carbon black "GP-E-3" (a product of Ryoyu Kogyo), 5.0 parts by weight of lauroyl peroxide, 9.0 parts by weight of tolylene diisocyanate "Coronate T-100" (a product of Nippon Polyurethane Industry Co., Ltd.) and 0.5 part by weight of phenyl isocyanate were added to a mixture comprising 50 parts by weight of styrene, 35 parts by weight of 2-ethylhexyl acrylate and 1.0 part by weight of divinylbenzene to give a polymerizable composition.

The composition was added to 800 g of a 4% by weight aqueous colloidal solution of tricalcium phosphate preliminarily prepared in a 2-l separable glass flask so as to give a concentration of 30% by weight. The obtained mixture was emulsified and dispersed with a TK homomixer (mfd. by Tokushu Kika Kogyo) at a rotational speed of 10000 rpm and 5° C. for 2 minutes. A four-necked glass cap was set on the flask, and a reflux condenser, a thermometer, a dropping funnel fitted with a nitrogen inlet tube and a stainless steel stirring rod were set thereon. The resulting flask was placed in an electric mantle heater. A solution of 22.0 g of resorcinol, 3.0 g of m-aminophenol, 2.2 g of t-butyl alcohol and 0.5 g of 1,4-diazabicyclo[2.2.2]octane in 40 g of ion-exchanged water was dropped into the flask through the dropping funnel under stirring over a period of 30 minutes. While stirring the contents in a nitrogen atmosphere, the contents were heated to 80° C. and reacted for 10 hours. The reaction mixture was cooled and the dispersant was dissolved with 10% aqueous hydrochloric acid. The resulting mixture was filtered to recover a solid. This solid was washed with water, dried under a reduced pressure of 20 mmHg at 45° C. for 12 hours, and classified with an air classifier to give a capsulate toner of a mean particle diameter of 9 μm having a shell made of a resin having a thermally dissociating urethane linkage.

0.4 part by weight of hydrophobic silica powder "Aerosil R-972" was added to 100 parts by weight of the above toner to give a toner according to the present invention. This toner will be referred to as "Toner 3". The glass transition assignable to the resin contained in the core was 33.5° C. and the softening point of Toner 3 was 130.5° C.

EXAMPLE 4

The same procedure as that of Example 1 was repeated except that 5.7 g of 4-acetylcatechol, 4.0 g of neopentyl glycol and 0.5 g of dibutyltin dilaurate were used instead of the resorcinol (22.0 g), diethyl malonate (3.6 g) and 1,4-diazabicyclo[2.2.2]octane (0.5 g). Thus, toner having a mean particle diameter of 9 μm and a shell made of a resin having thermally dissociating urethane linkages was obtained.

0.4 part by weight of hydrophobic silica powder "Aerosil R-972" was added to 100 parts by weight of the above toner to give a toner according to the present invention. This toner will be referred to as "Toner 4". The glass transition assignable to the resin contained in the core was 30.2° C. and the softening point of Toner 4 was 135.5° C.

EXAMPLE 5

The same procedure as that of Example 2 was repeated except that Takenate D-102 was used in an amount of 9.5 parts by weight (not 9.0 parts by weight) and no xylylene-1,4 diisocyanate was used and that 6.3 g of 4-chlororesorcinol, 2.7 parts by weight of diethylene glycol and 0.5 part of dibutyltin dilaurate were used instead of the 4-acetylcatechol (27.4 g), dimethyl malonate (4.0 g), 1,2-ethanediol (0.8 g) and 1,4-diazacyclo[2.2.2]octane (0.5 g). Thus, a toner having a mean particle diameter of 9 μm and a shell made of a resin having thermally dissociating linkages was obtained.

0.4 part by weight of hydrophobic silica powder "Aerosil R-972" was added to 100 parts by weight of the above toner to give a toner according to the present invention. This toner will be referred to as "Toner 5". The glass transition assignable to the resin contained in the core was 35.4° C. and the softening point of Toner 5 was 138.5° C.

EXAMPLE 6

The same procedure as that of Example 3 was repeated except that Coronate T-100 was used in an amount of 9.5 parts by weight (not 9.0 parts by weight) and no phenyl isocyanate was used and that 6.1 g of resorcinol, 5.9 g of m-aminophenol and 0.5 g of dibutyltin dilaurate were used instead of the resorcinol (22.0 g), m-aminophenol (3.0 g), t-butyl alcohol (2.2 g) and 1,4-diazacyclo[2.2.2]octane (0.5 g) Thus, a toner having a mean particle diameter of 9 μm and a shell made of a resin having thermally dissociating linkages was obtained.

0.4 part by weight of hydrophobic silica powder "Aerosil R-972" was added to 100 parts by weight of the above toner to give a toner according to the present invention. This toner will be referred to as "Toner 6". The glass transition assignable to the resin contained in the core was 33.5° C. and the softening point of Toner 6 was 137.5° C.

EXAMPLE 7

The same procedure as that of Example 1 was repeated except that 11.4 g of 4-acetylcatechol and 0.5 g of dibutyltin dilaurate were used instead of the resorcinol (22.0 g), diethyl malonate (3.6 g) and 1,4-diazabicyclo[2.2.2]octane (0.5 g). Thus, a toner having a mean particle diameter of 9 μm and a shell made of a thermally dissociating polyurethane resin was obtained.

0.4 part by weight of hydrophobic silica powder "Aerosil R-972" was added to 100 parts by weight of the above toner to give a toner according to the present invention. This toner will be referred to as "Toner 7". The glass transition assignable to the resin contained in the core was 30.2° C. and the softening point of Toner 7 was 35.0° C.

EXAMPLE 8

The same procedure as that of Example 5 was repeated except that 12.7 g of 4-chlororesorcinol and 0.5 g of dibutyltin dilaurate were used instead of the 4-chlororesorcinol (6.3 g), diethylene glycol (2.7 g) and dibutyltin dilaurate (0.5 g). Thus, a toner having a mean particle diameter of 9 μm and a shell made of a thermally dissociating polyurethane resin was obtained.

0.4 part by weight of hydrophobic silica powder "Aerosil R-972" was added to 100 parts by weight the above capsulate toner to give a capsulate toner of the above toner to give a toner according to the present invention. This toner will be referred to as "Toner 8". The glass transition assignable to the resin contained in the core 138.0° C.

EXAMPLE 9

The same procedure as that of Example 3 was repeated except that the tolylene diisocyanate (9.0 parts by weight) and phenyl isocyanate (0.5 part by weight) were replaced by 9.5 parts by weight of 4,4'-diphenylmethane diisocyanate "Millionate MT" and that 7.9 g of resorcinol and 0.5 g of dibutyltin dilaurate were used instead of the resorcinol (22.0 g), m-aminophenol (3.0 g), t-butyl alcohol (2.2 g) and 1,4-diazabicyclo[2.2.2]octane (0.5 g). Thus, a toner having a mean particle diameter of 9 μm and a shell made of a thermally dissociating polyurethane resin was obtained.

0.4 part by weight of hydrophobic silica powder "Aerosil R-972" was added to 100 parts by weight of the above toner to give a toner according to the present invention. This toner will be referred to as "Toner 9". The glass transition assignable to the resin contained in the core was 33.5° C. and the softening point of Toner 9 was 137.0° C.

COMPARATIVE EXAMPLE 1

The same procedure as that of Example 1 was repeated until the surface treatment step except that the resorcinol (22.0 g) and diethyl malonate (3.6 g) were replaced by 21.6 g of neopentyl glycol to give a toner. This toner will be referred to as "Comparative toner 1". The glass transition assignable to the resin contained in the core was 30.2° C. and the softening point of Comparative toner 1 was 137.0° C.

COMPARATIVE EXAMPLE 2

The same procedure as that of Example 2 was repeated until the surface treatment step except that the 4-acetylcatechol (27.4 g), dimethyl malonate (4.0 g) and 1,2-ethanediol (0.8 g) were replaced by 10.5 g of diethylene glycol to give a toner. This toner will be referred to as "Comparative toner 2". The glass transition assignable to the resin contained in the core was 35.4° C. and the softening point of Comparative toner 2 was 135.0° C.

COMPARATIVE EXAMPLE 3

The same procedure as that of Example 3 was repeated until the surface treatment step except that the resorcinol (22.0 g), m-aminophenol (3.0 g) and t-butyl alcohol (2.2 g) were replaced by 23.0 g of neopentylglycol to give a toner. This toner will be referred to as "Comparative toner 3". The glass transition assignable to the resin contained in the core was 33.5° C. and the softening point of Comparative toner 3 was 135.5° C.

COMPARATIVE EXAMPLE 4

The same procedure as that of Example 4 was repeated until the surface treatment step except that the 4-acetylcatechol (5.7 g) was replaced by 3.8 g of neopentyl glycol to give a toner. This toner will be referred to as "Comparative toner 4". The glass transition assignable to the resin contained in the core was 30.2° C. and the softening point of Comparative toner 4 was 137.0° C.

COMPARATIVE EXAMPLE 5

The same procedure as that of Example 5 was repeated until the surface treatment step except that the 4-chlororesorcinol (6.3 g) was replaced by 2.7 g of diethylene glycol to give a toner. The toner will be referred to as "Comparative toner 5". The glass transition assignable to the resin contained in the core was 35.4° C. and the softening point of Comparative toner 5 was 137.0° C.

COMPARATIVE EXAMPLE 6

The same procedure as that of Example 6 was repeated until the surface treatment step except that the resorcinol (6.1 g) and m-aminophenol (5.9 g) were replaced by 11.4 g of neopentyl glycol to give a toner, This toner will be referred to as "Comparative toner 6". The glass transition assignable to the resin contained in the core was 33.5° C. and the softening point of Comparative toner 6 was 137.5° C.

COMPARATIVE EXAMPLE 7

The same procedure as that of Example 7 was repeated until the surface treatment step except that the 4-acetylcatechol (11.4 g) was replaced by 7.8 g of neopentyl glycol to give a toner. This toner will be referred to as "Comparative toner 7". The glass transition assignable to the resin contained in the core was 30.2° C. and the softening point of Comparative toner 7 was 136.5° C.

COMPARATIVE EXAMPLE 8

The same procedure as that of Example 8 was repeated-until the surface treatment step except that the 4-chlororesorcinol (12.7 g) was replaced by 5.4 g of diethylene glycol to give a toner. This toner will be referred to as "Comparative toner 8". The glass transition assignable to the resin contained in the core was 35.4° C. and the softening point of Comparative toner 8 was 136.5° C.

COMPARATIVE EXAMPLE 9

The same procedure as that of Example 9 was repeated until the surface treatment step except that the resorcinol (7.9 g) was replaced by 7.5 g of neopentyl glycol to give a toner. This toner will be referred to as "Comparative toner 9". The glass transition assignable to the resin contained in the core was 33.5° C. and the softening point of Comparative toner 9 was 137.0° C.

COMPARATIVE EXAMPLE 10

The same procedure as that of Example 1 was repeated until the water washing step through the polymerization step except that none of the 4,4'-diphenylmethane diisocyanate, resorcinol, diethyl malonate and 1,4-diazabicyclo[2.2.2]octane was used. The obtained solid was dried under a reduced pressure of 10 mmHg at 20° C. for 12 hours and classified with an air classifier to give an uncapsulate toner having a mean particle diameter of 9 μm.

0.4 part by weight of a silica powder surface-treated with a silicone oil having an amino side chain "HVK-2150" (a product of Wacker Chemicals) was mixed with 100 parts by weight of the above toner to give a surface-treated toner. This toner will be referred to as "Comparative toner 10". The glass transition of Comparative toner 10 was 30.5° C. and the softening point thereof was 115.5° C.

52 parts of each of the toners prepared in the foregoing Examples and Comparative Examples was mixed With 1248 parts of a resin-coated Cu-Zn ferrite powder having a mean particle diameter of 90 μm to give a developer. The developers thus prepared were each used in a commercially available electrophotographic copying machine (organic electrophotographic photoreceptor, rotational speed of fixing roller: 255 mm/sec, temperature thereof: variable, not fitted with any oil applicator) to conduct printing.

The fixing temperature was controlled to be in a range of 100° to 220° C. to evaluate the fixability of the images and the offset resistance. The results are given in Table 1.

The term "lowest fixing temperature" used in this specification refers to the temperature of the fixing roller at which the fixing rate defined by the following equation exceeds 70%, wherein the densities are each the optical reflection density determined with a reflection densitometer mfd. by Macbeth before or after the rubbing of the images fixed with a fixing device with a sand eraser having an underside of 15 mm×7.5 mm five times under a load of 500 g:

$$\text{fixing rate} = \frac{\text{density of image after rubbing}}{\text{density of image before rubbing}} \times 100$$

Further, the toners were each allowed to stand under the conditions of 50° C. and a relative humidity of 40% for 24 hours to evaluate the extent of agglomeration. Thus, the blocking resistance was determined and the results are given in Table 1.

Furthermore, the electric charge was determined by the blow-off method.

TABLE 1

| | Electric charge (μc/g) | Lowest fixing temp. (°C.) | Disappearance temp. of low-temp. offset (°C.) | Generation temp. of high-temp. offset (°C.) | Blocking resistance |
|---|---|---|---|---|---|
| Toner 1 | +20 | 115 | 100 | 220< | good |
| Toner 2 | +19 | 120 | 110 | 220< | good |
| Toner 3 | +22 | 118 | 105 | 220< | good |
| Toner 4 | +19 | 120 | 110 | 220< | good |
| Toner 5 | +20 | 125 | 115 | 220< | good |
| Toner 6 | +21 | 124 | 110 | 220< | good |
| Toner 7 | +20 | 118 | 110 | 220< | good |
| Toner 8 | +20 | 124 | 115 | 220< | good |
| Toner 9 | +19 | 120 | 110 | 220< | good |
| Comp. Toner 1 | +19 | 170 | 110 | 220< | good |
| Comp. Toner 2 | +20 | 165 | 115 | 220< | good |
| Comp. Toner 3 | +21 | 170 | 105 | 220< | good |
| Comp. Toner 4 | +19 | 170 | 110 | 220< | good |
| Comp. Toner 5 | +19 | 170 | 115 | 220< | good |
| Comp. Toner 6 | +20 | 180 | 110 | 220< | good |
| Comp. Toner 7 | +19 | 170 | 110 | 220< | good |
| Comp. Toner 8 | +19 | 170 | 115 | 220< | good |
| Comp. Toner 9 | +20 | 180 | 110 | 220< | good |
| Comp. Toner 10 | +10 | 105 | 100 | 220< | bad |

As apparent from the results given in Table 1, Toners 1 to 9 according to the present invention each exhibited a low lowest fixing temperature and a wide non-offset temperature range and were not problematic in blocking resistance. Comparative toners 1 to 9 exhibited high lowest fixing temperatures, though they were not problematic in non-off-set temperature range and blocking resistance. Comparative toner 10 was poor in blocking resistance, though it exhibited a low lowest fixing temperature and a wide non-off-set temperature range. Comparative toner 10 is constituted only of the core of Toner 1. Accordingly, the above results of blocking resistance revealed that Toner 1 is a capsulate one.

What is claimed is:

1. An encapsulated toner for heat-and-pressure fixing, comprising a heat-fusible core containing at least a coloring material and a shell formed so as to cover the surface of the core, wherein the main component of the shell is a resin prepared by reacting: (A) an iso(thio)cyanate compound comprising (1) 0 to 30 mole % of monovalent isocyanate and/or isothiocyanate compounds and (2) 100 to 70 mole % of at least divalent isocyanate and/or isothiocyanate compounds;

with (B) an active hydrogen compound comprising (3) 0 to 30 mole % of a compound having one active hydrogen atom reactive with isocyanate and/or isothiocyanate groups and (4) 100 to 70 mole % of a compound having at least two active hydrogen atoms reactive with isocyanate and/or isothiocyanate groups at a molar ratio of component A to component B of between 1:1 and 1:20 and wherein at least 30% of all of the linkages formed from an isocyanate or isothiocyanate group are thermally dissociating linkages which are formed by the reaction of a phenolic hydroxyl or thio group with an isocyanate or isothiocyanate group;

said heat fusible core comprising, as a main component thereof, a thermoplastic resin having a glass transition temperature in the range of 10°-50° C.; and said encapsulated toner having a softening point in the range of 80° to 150° C.

2. The encapsulated toner for heat-and-pressure fixing as set forth in claim 1, wherein the compound having a phenolic hydroxyl group is at least one compound selected from among those represented by the following formulas (I), (II) and (III):

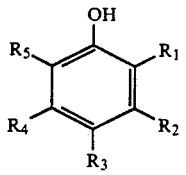

(I)

wherein $R_1$, $R_2$, $R_3$, $R_4$ and $R_5$ each independently represent a hydrogen atom, an alkyl group having 1 to 9 carbon atoms, an alkenyl, alkoxy, alkanoyl, carboalkoxy or aryl group or a halogen atom;

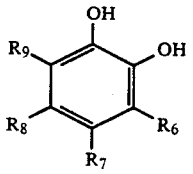

(II)

wherein $R_6$, $R_7$, $R_8$ and $R_9$ each independently represent a hydrogen atom, an alkyl group having 1 to 6 carbon atoms, an alkenyl, alkoxy, alkanoyl, carboalkoxy or aryl group or a halogen atom;

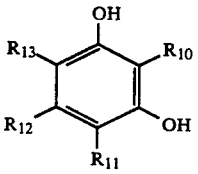

(III)

wherein $R_{10}$, $R_{11}$, $R_{12}$ and $R_{13}$ each independently represent a hydrogen atom, an alkyl group having 1 to 6 carbon atoms, an alkenyl, alkoxy, alkanoyl, carboalkoxy or aryl group or a halogen atom.

3. The encapsulated toner for heat-and-pressure fixing as set forth in claim 1, wherein the thermoplastic resin contained in the heat-fusible core is mainly a vinyl resin.

4. The encapsulated toner for heat-and-pressure fixing as set forth in claim 1, wherein the isocyanate group to be reacted with a phenolic hydroxyl group is directly bonded to an aromatic ring.

* * * * *